United States Patent [19]

Belenguer

[11] 4,343,432

[45] Aug. 10, 1982

[54] GUIDEWAY FOR CONTINUOUS WELDED RAIL

[76] Inventor: Frank J. Belenguer, P.O. Box 211, Stn. A, Kingston, Ontario, Canada, K7M 6R2

[21] Appl. No.: 59,799

[22] Filed: Jul. 23, 1979

[51] Int. Cl.[3] ..... E01B 29/02; E01B 29/42

[52] U.S. Cl. ..... 238/2; 104/2; 104/279; 238/25

[58] Field of Search ..... 104/3, 2, 279, 15, 118, 104/123, 124, 125, 126; 238/2, 5, 25

[56] References Cited

U.S. PATENT DOCUMENTS

| | | | |
|---|---|---|---|
| 2,750,118 | 6/1956 | Hastings | 238/25 |
| 3,999,276 | 12/1976 | Brown | 104/2 |
| 4,216,904 | 8/1980 | Vivion et al. | 238/35 |

*Primary Examiner*—Richard A. Bertsch

[57] ABSTRACT

According to this invention a guideway for railway vehicles and the like having beams or slabs extending between columns or footings comprises a continuous welded steel rail which is fixed directly to the columns or footings. The rail is prestressed in tension prior to fixing to the columns, the amount of prestressing being such that the rail remains in tension at all times that the guideway is usable. Thermally induced effects in the rail may lessen the tension in the rail with increasing temperature but do not fully relieve the tension when the guideway is usable. As the rail is in tension at all times that the guideway is operable no fasteners are used which would ordinarily transmit thermally induced forces to the beams or slabs. The rails are installed on the guideway according to the method of this invention in sections. Adjoining sections of rails are spaced apart a distance "X" and affixed to a column preferably other than at the end of the rail. The free portion of the sections of rail are stretched until in contact with each and then fixed to each other and the columns. The distance "X" is the amount the sections of rail would expand under thermally induced effects over the distance between fixation of the sections to the columns or footings.

17 Claims, 10 Drawing Figures

GUIDEWAY FOR CONTINUOUS WELDED RAIL

This invention relates to a process of installing continuous welded rail to constitute a track for railroad vehicles and the like, and the track work system resulting from carrying out this process.

Railroad vehicles and the like including at grade railways, subways, streetcar systems and elevated rail systems have long been used for the purposes of conveying passengers as well as freight. Continuous welded rail is desirable so as to provide a smooth ride which is important not only for passenger vehicles but also becomes important when higher speeds are attempted with freight carrying vehicles. Continuous welded steel rails have been widely used throughout the world to provide these advantages. However, in designing a continuous welded rail system close attention must be paid to the thermally induced forces.

As will be well-known to those skilled in the art, a continuous welded rail behaves as an infinite length of steel ribbon. The steel rails will expand and contract according to the coefficient of thermal expansion as the temperature rises or falls above the temperature at which the rail was laid. If the rail were free to move it would expand or contract axially along the road bed or guideway so as to relieve these forces. The magnitude of such displacement in a continuous welded track can be immense. The force to prevent such displacement is of very large magnitude.

To understand the invention made herein, and to appreciate the nature of this improvement reference must be first had to existing continuous welded rail systems. While continuous welded rail systems are used both in elevated systems and in at grade systems, the system may most easily be understood with reference to an elevated system. For the purposes of this description reference will be had specifically to prior art elevated systems and to the invention herein. However, it should be understood that this invention is equally usable with at grade systems and as will be explained later on, can be used to achieve substantial savings in at grade systems. The word beam is intended to include concrete slabs used in at grade systems and the word column is intended to include footings for an at grade system. The word guideway will be used to describe such concrete structures generally.

In an elevated guideway the columns supporting the guideway are spaced at intervals of from approximately 20 to 30 meters in a typical design. Extending between each of the columns is a concrete beam which carries the vertical loads imposed by the structure and the passing railroad vehicles. When considering thermally induced expansion of such a system, reference must be had both to the thermally induced expansion or contraction which occurs in the rail itself and also, consideration must be given to the thermally induced expansion of the concrete slabs. Typically, expansion joints must be used between the concrete beams. By virtue of the mass of the beam it is wholly impractical to attempt to have any structure massive enough to prevent the concrete slab from axial movement. Accordingly, columns are designed so as to provide for thermal expansion or contraction of the slabs in the axial direction. As used throughout this specification the term "axial" will be used to indicate forces or movement in a direction parallel to the rails. There is an expansion joint at each column which ensures that the concrete beams operate independently of each other as far as thermally induced forces are concerned and do not transmit these forces to the next adjoining beam. However, as the continuous welded rail is a single extending metallic member the thermally induced expansion of the rail is cumulative over distances between fixed points.

In prior art systems heavy anchors are used on spacings of up to one to two kilometers. These anchors provide sufficient support to maintain the forces necessary to prevent movement of the steel rails. Accordingly, the steel rail will not move with respect to the ground. However, the concrete beams which extend axially along the guideway will expand and contract and thus move with respect to the ground. Accordingly, there is relative movement between the steel rail and the concrete beam to which the rail is affixed by fasteners in typical prior art systems.

In typical prior art systems the fasteners are embedded in the concrete beam and supply up to 80% of the forces necessary to constrain the steel rail to limit movement of the rail under the effect of the forces generated by thermal effects. While these prior art systems have been widely used the concrete beam necessary to withstand such forces is particularly large and expensive. Because the fasteners which are typically spaced on approximately 50 cm centres pass the thermally induced forces generated in the rail to the concrete beam there are strong axial forces generated in the concrete beams. The beams thus must be designed to not only withstand the dead and live loads of the train, wind loads, etc., but must in addition have suitable strength in the axial direction for tangent track to locate each of the fasteners and to withstand the axial loading due to thermal effects transmitted to the beams by the fasteners.

It is an object of this invention to provide a system of installing rails upon a guideway wherein axial thermally induced forces are not transmitted to the beams constituting the guideway.

It is further an object of this invention to provide a guideway wherein fasteners which are designed to transmit axial loads generated by thermal effects to beams may be eliminated.

It is a further object of this invention to provide a process for installing continuous welded rail to a guideway whereby axial forces arising from thermal effects are not transmitted to beams extending between columns or footings.

The above and other objects of this invention are achieved by providing a guideway which permits relative movement between the rails and the concrete beams in the axial direction. The guideway comprises columns and beams extending between said columns. The continuous welded rail is fixed to the columns to prevent any relative axial movement between the rail and the columns. The rail is prestressed in tension such that at all temperatures below the maximum design temperature for operation of the track system, the rail is maintained in tension. No fasteners capable of transmitting significant axial forces are required to affix the rail to the beams.

According to this invention, a method for installing a section of continuous welded rail for use with railway vehicles and the like on a guideway comprising columns and beams extending between said columns comprising:

placing a section of rail on said guideway, fixing said section of rail to a first one of said columns, elongating a portion of said section of rail between said first one of said columns and a second column and fixing said section of rail to said second column, the amount of such elongation being equal to the length that said rail would expand for a temperature increase equal to the difference between the maximum temperature at which said guideway is to be operated and the temperature of said rail at the time of fixing said rail to said second column, for the length between said first and second columns.

According to this invention, a method for installing a plurality of sections of tangent steel rail for use with railway vehicles and the like on a guideway, said guideway comprising a plurality of columns and beams extending between pairs of columns comprising:

placing a first section of rail on said guideway and fixing said first section of rail to one of said columns at a first point of fixation, placing a second section of rail on said guideway in axial alignment with said first section of rail and axially spaced therefrom a distance "X", fixing said second section of rail to another of said columns at a second point of fixation, elongating said first and second sections of rail between said first and second points of fixation until said rails are substantially abutting and fixing said first and second sections of rails to said columns between said first and second points of fixation and to each other, where "X" is equal to the length that said rail would expand for a temperature increase equal to the difference between the maximum temperature at which said guideway is to be operated and the temperature of said rails at the time of fixing said second section over the length between said first and second points of fixation.

According to this invention, a guideway for tangent track for railway vehicles and the like comprising a plurality of columns and beams extending between pairs of columns and a continuous welded rail supported by said beams wherein said rail is fixed to said columns and wherein said rail is maintained in tension between the locations where said rail is fixed to said columns at all times when such guideway is operable.

A preferred embodiment of the invention, and method will now be discussed in greater detail in association with the following schematic diagrams in which:

FIG. 1 is a schematic illustration of an elevated guideway according to the prior art;

FIG. 1*b* illustrates the thermally induced effect that will occur in the system illustrated in FIG. 1;

Figure 1A:
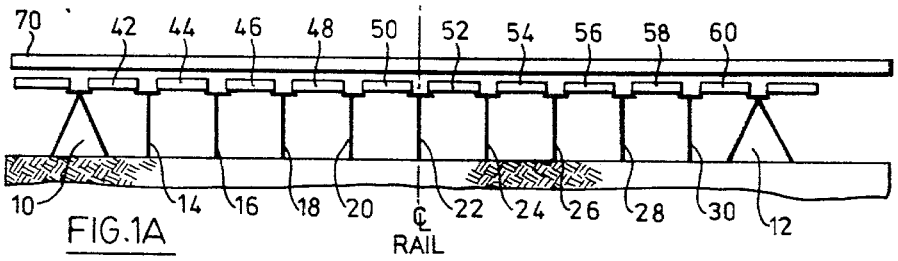

In order to fully understand the thermal forces occurring in guideways reference may be had to FIG. 1 which illustrates, schematically, the prior art guideways using continuous welded rail. For the purposes of the description of this preferred embodiment I will hereinafter use the term "guideway". However, it should be realized that the term "guideway" is intended to be broad enough to cover at grade systems. With the at grade system the beam hereinafter referred to would be considered a slab supported throughout its length by the road bed. In the at grade system the column hereinafter referred to would be replaced by a footing or other suitable anchor point located in the ground.

FIG. 1 illustrates an elevated guideway having 9 columns supporting beams having straight or tangent track located between anchors. The anchors are designated by the numerals 10 and 12 and the columns are designated by the numbers 14, 16, 18, 20, 22, 24, 26, 28 and 30. It will be observed that column 22 is in the centre of the length defined by the distance between the two anchors 10 and 12.

Each of the columns 14 through 30 supports two ends of adjacent beams. The beams are shown in FIG. 1 as 42, 44, 46, 48, 50, 52, 54, 56, 58 and 60. The rail is shown as line 70.

Figure 1B:
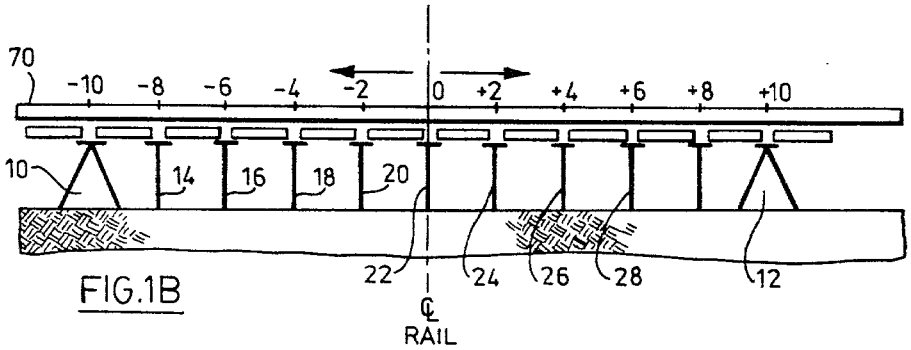

Under the effect of increased temperature the continuous welded rail would attempt to expand in either direction axially away from the centre point defined by column 22. This is illustrated in FIG. 1*b*. For the purposes of illustration in the drawing, expansion to the right has been identified by a positive sign, while expansion to the left is identified by a negative sign. It will be realized by those skilled in the art that the movement of the rail with respect to each column is cumulative. If the length of rail between columns 22 and 24 may be considered to be a unit length for which an expansion of +2 occurs, then, the portion of the rail immediately above column 26 would attempt to expand a distance of +4, the portion immediately above column 28 would attempt to expand +6 and so on as shown for each column until the amount reaches +10 and −10 at each of the anchors 12 and 10 respectively. Because of expansion joints between each of the adjoining concrete beams there is no cumulative thermally induced expansion of the beams and each beam may be considered to expand 2 units. The concrete and the rail have approximately the same coefficient of thermal expansion. The beams, however, will expand in both directions so that the length of expansion of the ends of the beams may be considered to be of opposite directions.

Figure 2:
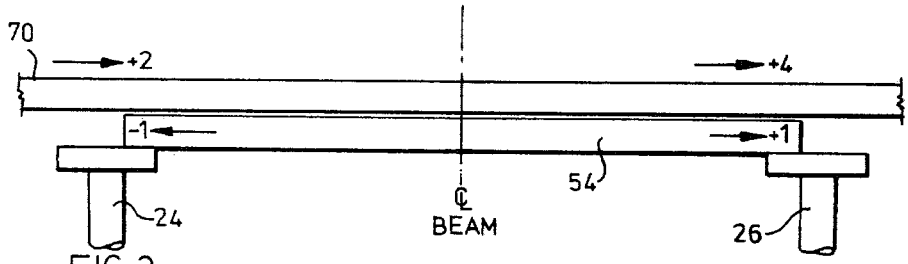
FIG. 2 illustrates the thermally induced effect in one of the beams illustrated in FIG. 1.

A single beam 54 is shown in FIG. 2 schematically. If the beam is considered as an independent member for expansion and contraction in the axial direction and if the beam is considered to have a unit length and a total expansion of 2 units, then it may be observed that the right hand end of beam 54 as shown in FIG. 2 will expand outwardly a distance of +1. Similarly, the left hand end of beam 54 will expand outwardly a distance −1. However, as indicated above, the rail mounted on this beam which is expanding from its centre point defined by column 22, will expand only outwardly to the right in the positive direction. The expansion of the rail at column 24 is +2 whereas the expansion at column 26 is +4. Accordingly, the rail relative to the beam has undergone considerable movement. The fasteners employed to locate the rail to the beam are then put under severe axial loading and the axial loads are transferred to the beam. The beam is free to slide along the columns 26 and 24. However, there is friction provided and accordingly, the axial forces developed in the beam can be as high as the weight of the beam itself assuming a coefficient of friction of 1.0 between the beam and its supporting columns 24 and 26. The thermal force transferred to the beam can be quite significant.

Figure 3:
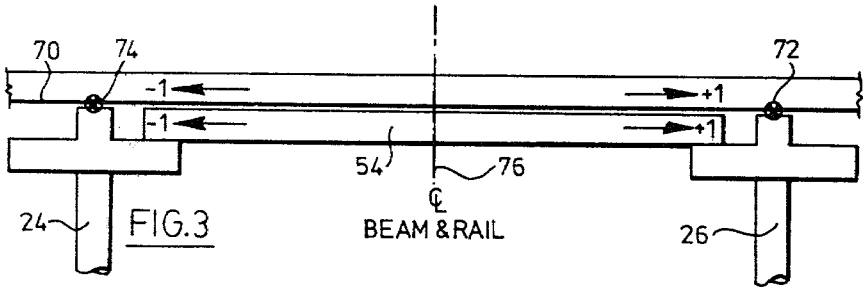
FIG. 3 illustrates a theoretical analysis of the beam illustrated in FIG. 2 wherein the rail and beam expand equally in thermal effects.

In order to assist in understanding this invention, it is helpful to consider the solution to the prior art problems from a theoretical point of view as constituting a number of conceptual steps. As a first step, assume that the rail rather than being fixed to the beam with fasteners merely rests in a guidance channel within the beam 54. Also, consider that in place of fixing the rail to the beam using typical fasteners that the rail is fixed directly to each of the columns 24 and 26 as shown schematically in FIG. 3. The rail 70 is fixed to column 26 at point 72 and to column 24 at point 74. By fixing the rail to each of the columns at 72 and 74 and assuming that each of these columns 24 and 26 have sufficient bending moment strength to be considered as anchors, then both the beam 54 and the section of rail 70 between points 72 and 74 have the same centre line 76. Thermally induced expansion or contraction of the rail or the beam provides for identical expansion as shown in FIG. 3. The right hand end of beam 54 will expand an amount of $+1$ and the left hand amount will expand an amount $-1$. The portions of the rail directly over the ends of the beam 54 will similarly expand $+1$ and $-1$ assuming that the concrete and the steel have the same coefficient of expansion. It will be understood by those skilled in the art that concrete used for the purposes of a guideway will have essentially the same coefficient of expansion over all practical temperatures as steel.

Assuming that the conceptual second step of this design is to occur consider that the section of rail 70 extending between points 72 and 74 is maintained in tension. Fasteners are required with respect to conventional systems to prevent the buckling of the rail under the compressive forces normally exerted by the anchors when the temperature increases beyond the installation temperature. If however, the rail is kept in tension, then there is no need for such fasteners. For this reason, the rail may simply be placed in a guidance channel contained within the beam 54. If rail 70 is in tension at all times the rail will be self-aligning. In installing such a system a temperature must be chosen for each geographic area, which will be the highest temperature under which the system is designed for operation. The rail 70 is installed in such a manner, to be explained more particularly hereinafter, that the rail 70 will always be in tension when the temperature is less than the design temperature. Obviously, as one skilled in the art will well appreciate, as the ambient temperature of the rail increases beyond that at which the rail was installed, the rail will attempt to expand and will thereby decrease the tension. It is however important to this design that the rail be maintained in tension at all times when the system is operable.

The third step in this conceptual analysis is the recognition that by virtue of the fact that no fasteners are required then the beam may be designed with regard only to the loads imposed by the dead and live loads of the vehicle and such other forces as wind loads and curve forces, etc. as would normally be involved. The elimination of the axial loads imposed by thermally induced expansion of the rail, ensures that the beam may be then lighter.

The final conceptual step in this design is the recognition that because the beam is itself lighter the column supporting the beam can also be made slightly lighter. It should be understood however that the columns required by the guideway of this invention must carry the same bending moment as would have been previously applied in prior art designs. The saving is in elimination of costly fasteners and in the mass of the beams and in the reduced maintenance.

Figure 4:
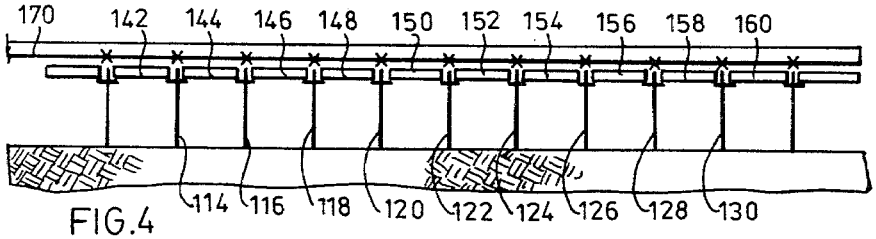
FIG. 4 illustrates an embodiment of the invention.
Figure 5:
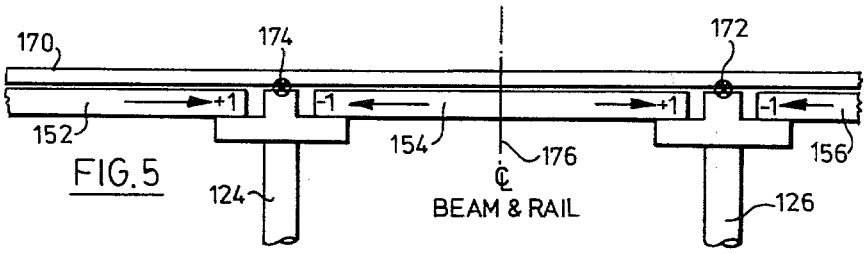
FIG. 5 illustrates a single beam of FIG. 4 and illustrates the thermally induced effects upon the rail and beam.

FIG. 4 is similar to FIG. 1 and illustrates schematically a guideway in accordance with this invention. In a section of tangent track of the same length as that shown in FIG. 1 a number of columns 114, 116, 118, 120, 122, 124, 126, 128 and 130 support a guideway comprising a series of beams 142, 144, 146, 148, 150, 152, 154, 156, 158 and 160. It will be observed that large anchors equivalent to anchors 10 and 12 of FIG. 1 have been eliminated from the guideway. Column 122 is the centre line of the section of tangent track which is under analysis and the direction of thermally induced expansion and forces on each of the columns may be analysed. However, because the rail is fixed to each column, column 122 is not the centre line of expansion for each section of rail between columns. To more clearly appreciate the difference reference should be made to FIG. 5 which illustrates columns 124 and 126 and beams 152, 154 and 156. The rail is shown as line 170.

Each section of rail and underlying beam in a tangent section of track will be similar. The centre line of the section between columns 124 and 126 is shown as 176. The rail is fixed to column 124 at 174 and to column 126 at 172. The ends of beam 154 will each extend outwardly from centre line 176 a distance of $-1$ unit under thermally induced effects. This expansion occurs by sliding along the expansion space provided at each column.

Rail 170 is maintained in tension. Accordingly, as the rail expands under thermally induced effects the magnitude of the tensile stress in the rail will decrease. As temperature decreases the tensile stress in the rail 170 will increase.

As the rail 170 is maintained in tension at all temperatures below the design temperature and as the rail is continuous the axial forces at each column will be equal and opposite. Accordingly, for those columns in the centre of a length of tangent track such as 120, 122 and 124 there will be no bending moment applied to the column. However, for those columns at the end of the section under consideration such as 114 and 130, there will be an inward force exerted by the tensile stresses in the rail. The cooler the temperature below the design temperature, the greater will be the tensile stress in the rail and the greater the forces applied to the end columns 114 and 130. These columns accordingly must provide support for the bending moment in the columns.

It should be appreciated that in the prior art designs the anchors were required because the rail was not affixed to the columns directly. In prior art designs the loads from the rail were absorbed first by the fasteners which passed the axial forces into the beams which then passed the load to the columns. As the fasteners in use today typically cannot absorb more than 80% of the stresses induced by thermal expansion, the anchors were required. With the system according to this invention the rail is fixed directly to each of the columns and accordingly the stresses within each section of rail between the columns are transferred to and supported directly by the columns. The columns 114 and 130 thus are supported in part by the adjacent columns 128 and 116 respectively. Over a considerable length of tangent track it will be observed that the columns toward the centre of the tangent track are experiencing little or no axial force under the tensile stress, whereas those columns toward the end of each section of tangent track will absorb the tensile forces.

However, as a matter of safety it will be well understood that in the event of a breakage in the track, any one of the columns might at some time or other be considered to be an end column. Thus, all of the columns 114 through to 130 are designed of equal strength and act to mutually support the axial loads imposed by thermal forces.

Figure 6:
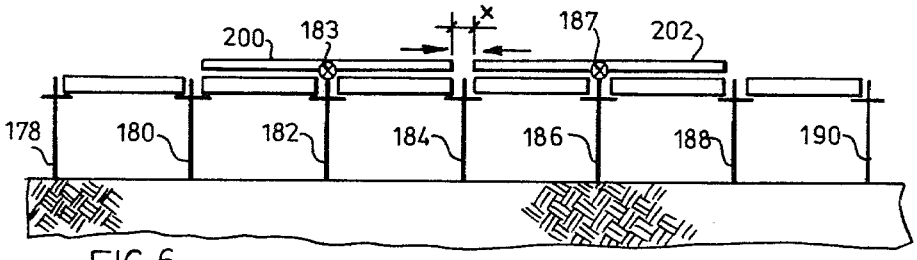
FIG. 6 illustrates a method for installing continuous welded rail on a guideway in accordance with this invention.

In order to understand the process for installing the rail such that it is always in tension, reference should be had to FIG. 6. FIG. 6 diagrammatically illustrates seven columns 178, 180, 182, 184, 186, 188 and 190. As the beams do not play any role in fixing the tracks, the beam numbers have been deleted from the diagrammatic view in order to fully understand the process for installing the track to the guideway. Each of the columns will be assumed to be on an equal spaced pattern. Although not all columns need be spaced equally the columns should conveniently be spaced in pairs for reasons which will be understood and explained hereinafter. A first section of rail 200 is placed over the guideway. It will be observed that rail 200 is of a length approximately equal to two of the spans between the columns. A second rail 202 is placed in axial alignment with rail 200 separated by a distance "X" from rail 200. Rail 200 is then fixed to column 182 at the centre line of the column at a point 183. Rail 202 is similarly affixed to the centre line of column 186 at a point 187. The normal mode of fixing the rail to the columns will be by welding and the columns will be provided with a substantial steel plate on their uppermost surface for accommodating and facilitating this welding operation. The temperature of the rails 200 and 202 must be determined prior to establishing the distance "X". Using equipment well-known in the art the rails 200 and 202 are then stretched against each other so as to abut. Such rail stretching equipment is well-known to those skilled in the art. As the two rails are identical the ends will meet at the centre line of column 184 at which time the two rails are then welded directly to a similar steel plate at the top of column 184. The rails may also be butt welded, one to each other, or other filler may be used so as to provide the continuous welded rail joint all in accordance with well-known technology.

It is to be observed that the point of fixation to column 184 is equidistant between the points 183 and 187 of fixation of the rails 200 and 202 prior to stretching. The distance "X" for any particular installation is determined by taking the temperature of the rail immediately prior to fixing to columns 182 and 186. The length "X" is then the distance over which the rail being installed for the length between the centre line of columns 182 and 186 would expand for the difference in temperatures between the design temperature of the track system and the temperature of the rails. The distance "X" will depend upon the particular rail being used. The designer must also realize that as the temperature cools below the design temperature the tensile stress in the rails will increase. Accordingly, the rails must be designed to accommodate the tensile stress that will occur at the lowest operating temperature expected to be encountered for the geographic area in which the rail is installed.

Figure 7:
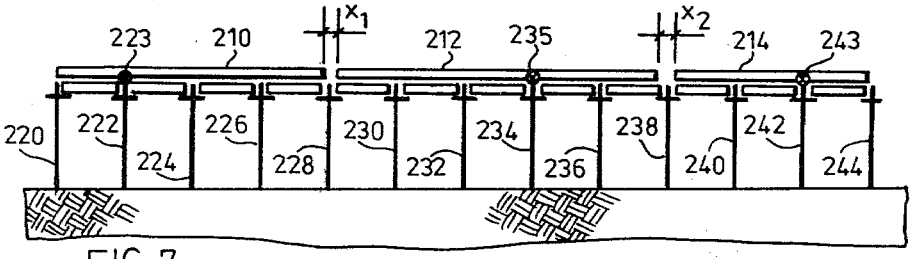
FIG. 7 illustrates an embodiment of the method for installing rail in accordance with the invention when the sections of rail are of unequal length.

FIG. 7 illustrates an embodiment of the method of affixing as shown in FIG. 6 with the exception that the rail sections 210, 212 and 214 are of different lengths. In this illustration the rail 210 may be welded to column 222 at a point 223 of the rail. Rail 212 is placed in axial alignment with rail 210 and spaced apart a distance "X". Rail 212 is then welded to column 234 at point 235. It is to be noted that column 228 to which rails 210 and 212 are to be attached is equidistant from points 223 and 235. Then as explained with reference to FIG. 6 the rail stretching mechanism may be used to draw the two ends together such that the rails may then be welded to column 228 and to each other. After welding to column 228 or while the rails are stretched the rails may be welded to columns 224, 226 and 230, 232 respectively.

From analysing FIG. 7 it should be recognized that the important point is that the rails must be affixed to the supporting columns in such a manner that the rails are stretched toward the midpoint between the first point of fixation. This enables the rails to be stretched against each other so as to eliminate an outside anchor point. It is to be noted that rail 212 is of a length approximately equal to the span between 5 columns. Thus after the step explained immediately above, this rail 212 will be fixed to columns 228, 230, 232 and 234. The next adjacent rail 214 is then placed in axial alignment with rail 212 and spaced therefrom a distance "$X_2$". Rail 214 must be long enough to reach to or beyond column 242. Rail 214 is affixed to column 242 at point 243. Column 238 is then equidistant from points 235 and 243. Rails 212 and 214 can then be stretched toward each other and welded to column 238 and to each other. Note that the distances "$X_1$" and "$X_2$" would not be the same assuming temperature remains constant. This is because a greater length of rail is being stretched to close gap "$X_1$" than when closing gap "$X_2$".

In the foregoing it has been suggested that each rail section should first be fixed to a column other than at the end of the rail. This permits an efficient system of stretching two sections of rail toward a midpoint. There may, however, be situations where this is not possible. Column spacing may have to be unequal because of geographic factors. The presence of curves may also require odd length sections. To install rail according to this invention it is only necessary to have an anchor point against which the rail may be pretensioned. Accordingly, over short sections the rail may be installed by fixing the rail to a first column. The rail may then be prestressed in tension using the next column as an anchor and welding the rail to that column.

Figure 8:
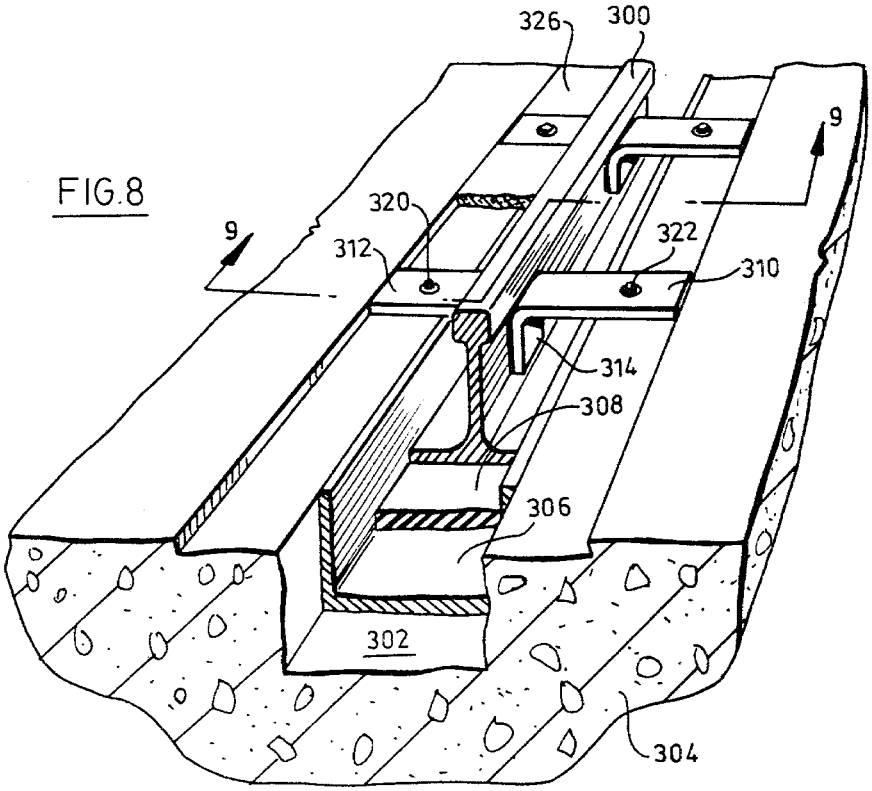
FIG. 8 is a broken down isometric sectional view of a guideway and rail in accordance with this invention.

FIG. 8 is a broken away isometric section view of a concrete beam having a track installed thereon in accordance with the invention.

Figure 9:
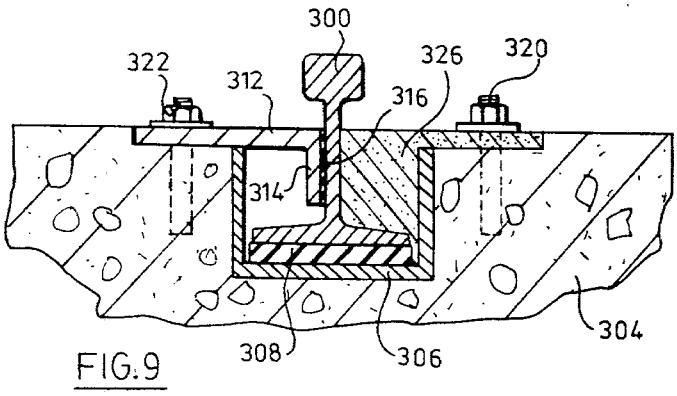
FIG. 9 is a vertical cross-sectional view through the guideway of FIG. 8.

FIG. 9 is a vertical cross-section through the beam of FIG. 8. The rail 300 is supported in a guidance groove indicated generally as 302 contained in the concrete beam 304. Concrete beam 304 may be a simple concrete structure or may involve any of the more sophisticated techniques of compound complex structures involving various forms of reinforcing. In the preferred embodiment the guidance groove would be lined with a channel shaped steel member 306 to facilitate construction of the track work system, constant gauge and rail alignment. It should be observed that the channel shaped steel member 306 is only slightly wider than the bottom flange of the rail 300 such that the rail is partially maintained in axial alignment by the guidance groove. A resilient pad 308 may be placed under the flange of the rail so as to minimize the transmission of vibration and noise to the concrete structure.

As the rail 300 shown in FIGS. 8 and 9 is under tension, the rail will be self-aligning and has no tendency to move within the groove. It should also be understood by those skilled in this field that the concrete beam 304 will, in a typical situation, be precambered so as to have a slight upward curve. This slight upward curve together with the tension in the rail 300 will be more than sufficient to maintain the rail in its alignment.

However, by reason of the unstable forces in the train as may arise when approaching curves or the tendency of the train to yaw as it travels along the path there will be some horizontal force perpendicular to the axis of the rails. In order to support the rail against these horizontal forces a pair of controlling clips are installed. These clips 310 and 312 illustrated in FIG. 8 comprise a substantially horizontal section which extends away from the rail and over the concrete portion of the beam 304 and a vertical section 314 which is adjacent to the rail. Clip 312 is not shown in FIG. 9 for greater clarity of other features. As the clips are not intended to take any axial load the clips need not be in direct contact with the rails. It is suggested that these clips may best contact the rails through resilient pads 316 shown in FIG. 9 which will assist in minimizing noise and vibration transmission. It will also be observed that these clips will not provide any axial location of the rail and accordingly, will not transmit any axial forces to the beam 304. The controlling clips are each affixed to the beam 304 by means of simple lag bolts 320 and 322 respectively. The controlling clips have an axial length of approximately 15 cm and would be spaced along the guideway at intervals of approximately 1 to 2 meters. Finally after installation of the rails and controlling clips the entire channel is filled with HL1 grade asphalt 326. The asphalt simply fills the channel 302 to prevent water and dirt accumulation therein. In addition it provides for a relatively flatter surface for the guideway which may be advantageous for safety.

It will be observed that according to this invention a guideway has been provided which has eliminated the traditional fasteners and thereby reduced the associated maintenance. Similarly, by removing the axial loads upon the beam the beam may be much lighter. By reason of the lightening of the beams the columns supporting the guideway can also be reduced in size. Each of these advantages is also applicable to an at grade system using continuous welded rail and a continuous or discontinuous concrete slab. At grade systems are much easier to design than elevated systems in that the slab may be a continuous slab without use of expansion joints. It is well known to those skilled in the art that continuous concrete slabs will crack in time as a result of the thermally induced forces. This cracking is not of any significance to an at ground system where the slab is supported throughout its length by the underlying earth. The system of this invention may be used in at ground systems if it is considered that each footing for the system takes the place of a column as described hereinabove. By using such footings and by having sections of track which extend at least the distance between such footings, then the track may be affixed to the footings in the same manner as discussed above with respect to columns and thereby eliminating the need for the usual fasteners if the rail is pretensioned. Accordingly, considerable savings both in installation and maintenance will occur both in above grade and at grade installations using the track system of this invention arising from elimination of the typical fasteners. Throughout this specification reference has been made to welding the rails to the columns. However, other means of fixation to the columns such as through bolting may be utilized without departing from the scope of this invention.

I claim:

1. A guideway for tangent track for railway vehicles and the like comprising a plurality of supporting columns, a plurality of beams supported by said columns, a continuous welded rail supported by said beams and by said columns, wherein said rail is fixed to said columns and wherein said rail is maintained in tension between the locations where said rail is fixed to said columns when said rail is below a selected temperature which temperature is above the highest expected operating temperature of said rail.

2. A guideway for tangent track for railway vehicles and the like comprising a plurality of columns and beams extending between pairs of columns and a continuous welded rail supported by said beams wherein said rail is fixed to said columns and wherein said rail is maintained in tension between the locations where said rail is fixed to said columns at all times when such guideway is operable.

3. The guideway of claim 2 wherein said rail is located with respect to said beam by means of a plurality of controlling clips spaced along said rail each of said controlling clips comprising a first substantially horizontal flange and means securing said horizontal flange to said beam and a substantially vertical flange adjacent to a vertical flange of said rail.

4. The guideway of claim 3 wherein said guideway comprises a guidance groove for locating said rail with respect to said beams.

5. The guideway of claim 4 wherein said guidance groove contains a resilient pad on which said rail is supported and wherein each of said controlling clips is spaced from said rail by a resilient material.

6. The guideway of claim 5 wherein said clips do not transfer axial loads arising in said rail from thermally induced effects to said beam.

7. The guideway of claim 6 wherein thermally induced forces arising in said rail are not transferred to said beam.

8. The guideway of claim 7 wherein said guideway is elevated.

9. The guideway of claim 6 wherein said guideway is at grade.

10. The guideway for tangent track for railway vehicles and the like comprising a plurality of supporting columns, a plurality of beams supported by said columns, a continuous welded rail supported by said beams and by said columns, wherein said rail is fixed to said columns, and where said rail is prestressed in tension between the locations where said rail is fixed to said columns, such that said rail is in tension at all temperatures below a selected temperature, the selected temperature being the maximum temperature at which said guideway may be operated.

11. The guideway of claim 10 wherein said guideway comprises a guidance groove for locating said rail with respect to said beams and a plurality of controlling clips spaced along said rail each of said controlling clips comprising a first substantially horizontal flange, means securing said horizontal flange to said beams, a substantially vertical flange on said clips adjacent to a vertical flange of said rail.

12. The guideway of claim 11 in which said rail is not fixed to said beams by means of any devices which transmit thermally induced forces within said rail to said beams.

13. A guideway for railway vehicles comprises a plurality of spaced supporting columns, at least one beam, each such beam extending between a pair of adjacent support columns to be supported thereby, a pair of parallel rails traversing said columns and supported in a vertical direction by said beams, locating means acting between said rails and said beams to inhibit relative movement between said rail and said beam in a direction transverse to the longitudinal axis of said beam whilst permitting such relative movement in a direction along the longitudinal axis of said beam, and fastening means to secure said rails to said columns and prevent displacement of said rails along said longitudinal axis, whereby stress induced in said rail due to variations in ambient temperature is reacted by said columns through said fastening means and differential displacement between said beam and said rail is permitted.

14. A guideway according to claim 13 wherein said rails are stressed prior to attachment to said columns so as to be in tension at all times.

15. A guideway according to claim 13 wherein said fastening means includes a plate embedded in said supporting column and welded to said rail.

16. A guideway according to claim 15 wherein said locating means includes a pair of recessed troughs formed in an upper surface of said beam and each accommodating a respective one of said rails.

17. A guideway according to claim 16 including clips projecting from said upper surface and abutting said rail.

* * * * *